US008826835B1

(12) United States Patent
Mathis, Jr. et al.

(10) Patent No.: US 8,826,835 B1
(45) Date of Patent: Sep. 9, 2014

(54) CONTROLLING CARBON CONTENT IN CONVEYED HEATED MATERIAL

(75) Inventors: Oscar L. Mathis, Jr., Cary, IL (US); Adam Fernandez, Lake Zurich, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 240 days.

(21) Appl. No.: 13/353,093

(22) Filed: Jan. 18, 2012

Related U.S. Application Data

(60) Provisional application No. 61/433,709, filed on Jan. 18, 2011.

(51) Int. Cl.
*F23H 7/08* (2006.01)
*B65G 27/00* (2006.01)

(52) U.S. Cl.
USPC ..... 110/281; 110/248; 198/752.1

(58) Field of Classification Search
USPC ..... 198/752.1; 110/248, 249, 250, 251, 110/281, 282, 283, 284; 406/134, 168
See application file for complete search history.

(56) References Cited

U.S. PATENT DOCUMENTS

| | | | | |
|---|---|---|---|---|
| 3,348,589 | A | | 10/1967 | Krauss |
| 3,770,097 | A | | 11/1973 | Musschoot |
| 3,885,606 | A | | 5/1975 | Krauss |
| 3,989,227 | A | | 11/1976 | Musschoot |
| 4,306,359 | A | | 12/1981 | Hoyt |
| 4,389,978 | A | | 6/1983 | Northcote |
| 4,415,444 | A | | 11/1983 | Guptail |
| 4,503,783 | A | | 3/1985 | Musschoot |
| 4,516,510 | A | * | 5/1985 | Basic, Sr. ..... 110/346 |
| 4,646,759 | A | | 3/1987 | Thatcher et al. |
| 4,708,534 | A | | 11/1987 | Gallant |
| 4,715,763 | A | | 12/1987 | Galgana et al. |
| 4,724,779 | A | | 2/1988 | White et al. |
| 4,775,516 | A | * | 10/1988 | Kempster et al. ..... 422/80 |
| 4,901,652 | A | | 2/1990 | Pressnall et al. |
| 5,018,909 | A | | 5/1991 | Crum et al. |
| 5,024,596 | A | | 6/1991 | Smith |
| 5,713,345 | A | | 2/1998 | Bentsen et al. |
| 5,775,237 | A | | 7/1998 | Reilly et al. |
| 6,241,951 | B1 | | 6/2001 | Musschoot et al. |
| 6,655,304 | B1 | * | 12/2003 | Barlow ..... 110/347 |
| 6,745,705 | B1 | | 6/2004 | Benesch et al. |

(Continued)

FOREIGN PATENT DOCUMENTS

| | | |
|---|---|---|
| CA | 2546587 | 6/2005 |
| DE | 311639 | 3/1914 |
| DE | 447081 | 7/1927 |

(Continued)

*Primary Examiner* — Douglas Hess
(74) *Attorney, Agent, or Firm* — Marshall, Gerstein & Borun LLP

(57) ABSTRACT

A system for reducing carbon content of hot ash includes a conveyor including a trough to receive a quantity of hot ash, the trough having a trough wall with a plurality of apertures through which air may pass, and a vibratory generator operatively coupled to the trough to move the quantity of hot ash along the trough. The system also includes a controlled air supply including an adjustable air supply, a temperature sensor operatively associated with the trough, and a controller operatively coupled to the adjustable air supply and the temperature sensor. The controller is programmed to adjust the air supply to maintain a constant temperature associated with controlled oxidation of unburned carbon in the hot ash within the trough in response to the signal received from the temperature sensor.

12 Claims, 9 Drawing Sheets

(56) References Cited

U.S. PATENT DOCUMENTS

| | | | | |
|---|---|---|---|---|
| 6,994,207 | B2 * | 2/2006 | Takasan et al. | 198/752.1 |
| 7,047,894 | B2 * | 5/2006 | Crafton et al. | 110/344 |
| 7,146,915 | B2 | 12/2006 | Magaldi | |
| 7,559,725 | B2 | 7/2009 | Mathis, Jr. et al. | |
| 7,632,092 | B2 * | 12/2009 | Mersmann et al. | 432/77 |
| 7,849,997 | B2 | 12/2010 | Mathis, Jr. et al. | |
| 2005/0115477 | A1 | 6/2005 | Magaldi | |
| 2007/0128565 | A1 | 6/2007 | Mersmann et al. | |
| 2008/0210718 | A1 | 9/2008 | Fruit et al. | |

FOREIGN PATENT DOCUMENTS

| | | |
|---|---|---|
| DE | 3416526 | 1/1985 |
| DE | 19528765 | 2/1997 |
| EP | 0931981 | 7/1999 |
| WO | WO 82/00188 | 1/1982 |
| WO | WO 97/00406 | 1/1997 |
| WO | WO 2005/052482 | 6/2005 |

* cited by examiner

CONTROLLING CARBON CONTENT IN CONVEYED HEATED MATERIAL

The present application claims benefit of U.S. Provisional Application No. 61/433,709, filed on Jan. 18, 2011, the disclosure of which is hereby incorporated by reference in its entirety.

BACKGROUND

This patent is directed to a conveyor for and a method of conveying heated material, and, in particular, to a vibratory conveyor for and method of conveying heated material, such as hot ash, while controlling the carbon content of the heated material.

It is known to provide a conveyor to convey heated material while simultaneously treating the heated material to cool the heated material. For example, U.S. Pat. No. 7,849,997 discusses a system of one or more conveyors that may be used to convey hot ash. These conveyors include a trough for receiving the hot ash, the wall of the trough having a plurality of apertures to permit cooling air to pass therethrough and into the hot ash disposed in the trough. The conveyor may be associated with an air supply and control system, which system may include a controller that is operatively coupled to a temperature sensor and may operate the system in accordance with signals returned to the controller from the sensor. The placement of one or more sensors may permit focused and localized response to variations along the conveyor.

SUMMARY

In one aspect, a system for reducing carbon content of hot ash includes a conveyor including a trough to receive a quantity of hot ash, the trough having a trough wall with a plurality of apertures through which air may pass, and a vibratory generator operatively coupled to the trough to move the quantity of hot ash along the trough. The system also includes a controlled air supply including an adjustable air supply, a temperature sensor operatively associated with the trough, and a controller operatively coupled to the adjustable air supply and the temperature sensor. The controller is programmed to adjust the air supply to maintain a constant temperature associated with controlled oxidation of unburned carbon in the hot ash within the trough in response to the signal received from the temperature sensor.

Additional aspects of the disclosure are defined by the claims of this patent.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Boiler, Hopper and Conveyor System

Figure 1:
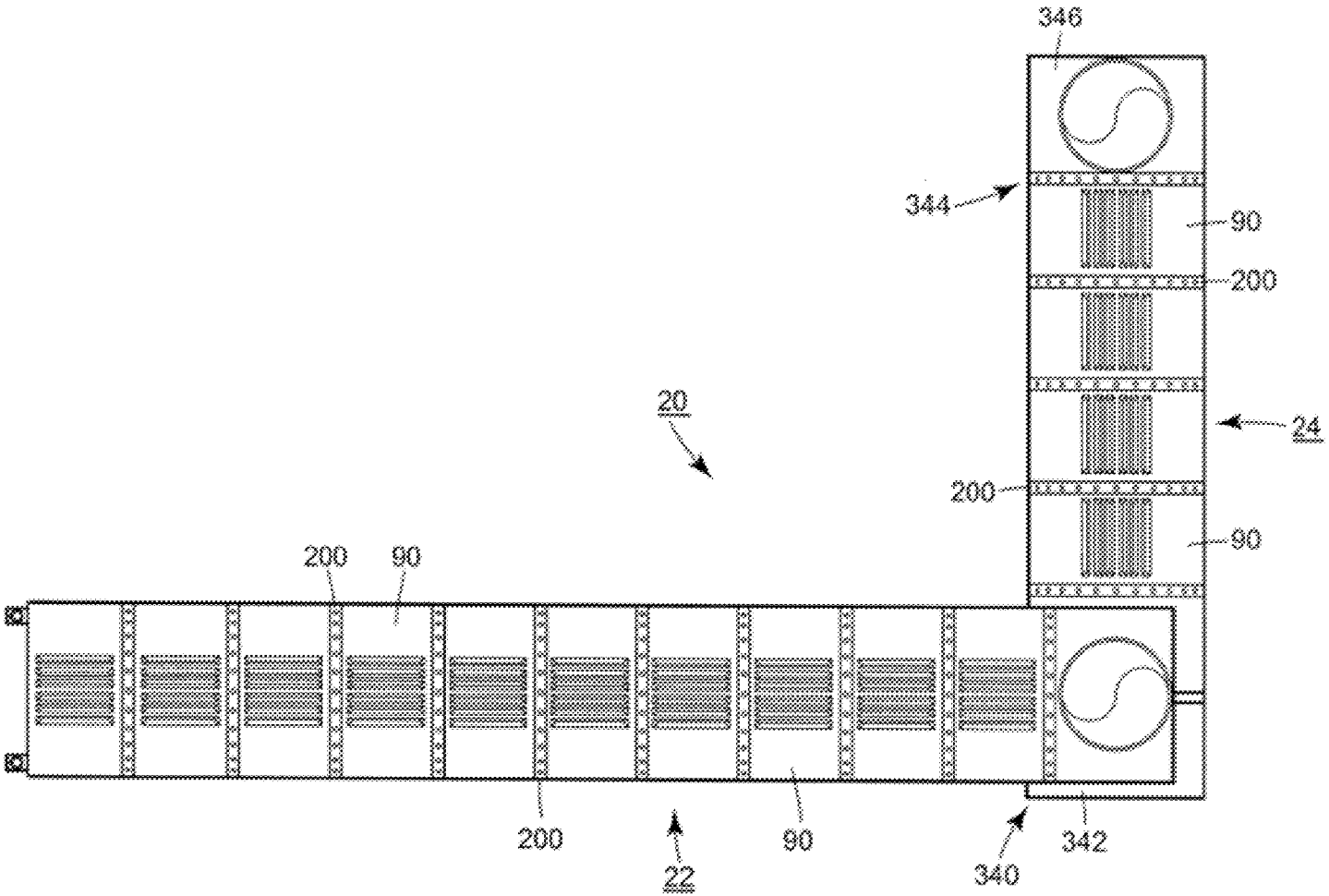
FIG. 1 is a plan view of an embodiment of a system including a conveyor according to the present disclosure.
Figure 2:
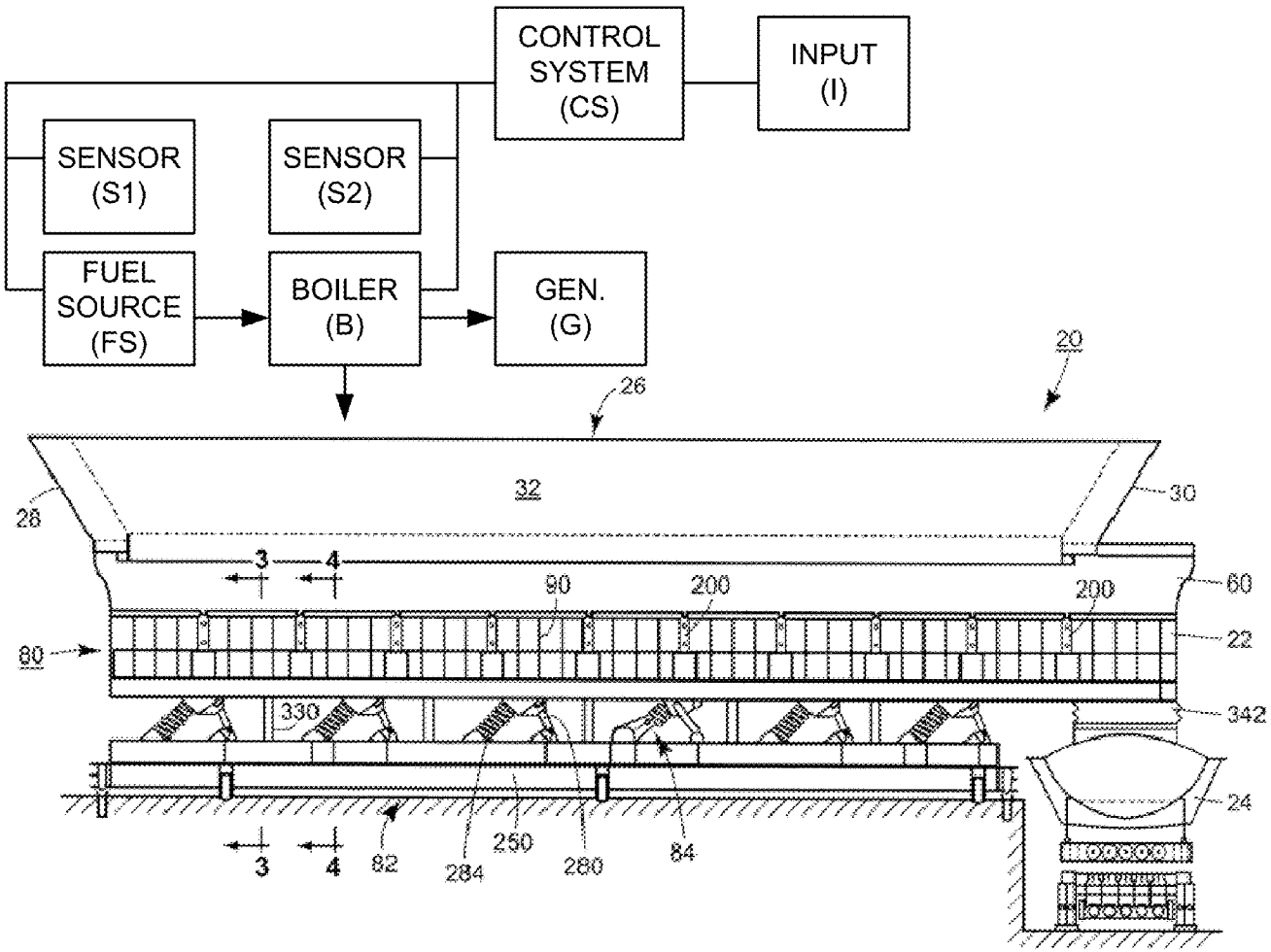
FIG. 2 is a side view of the system illustrated in FIG. 1 with an associated air supply system removed.

FIGS. 1 and 2 illustrate an embodiment of a conveyor system 20 for conveying heated materials, such as hot ash, which system 20 may be used in combination with a controlled air supply, for example as also described herein, for the purpose of controlling carbon content in the heated material passing through the conveyor system 20. The system and method for controlling and reducing carbon content in a heated material should not be thought of as limited to only such an embodiment of a conveyor system 20, however. The system and method for controlling the carbon content are discussed in regard to this embodiment of the conveyor system 20 simply for ease of illustration.

The conveyor system 20 may include two conveyors 22, 24, although a conveyor system 20 according to the present disclosure may include only one such conveyor. The conveyor 22 may be referred to as a receiving conveyor, and the conveyor 24 may be referred to as a transfer conveyor. While the conveyors 22, 24 may be very similar structurally and may operate similarly, this need not be the case in all such systems 20; for example, the transfer conveyor 24 may be a different type of conveyor altogether. Likewise, there is no intended limitation as to how conveyors 22, 24 may be arranged in a system 20 by virtue of the illustration of FIGS. 1 and 2.

As illustrated, the system 20 may be used in conjunction with a transition hopper 26 to facilitate the movement of heated material into the conveyor 22. The transition hopper 26 may be associated with a boiler (B), which boiler produces hot ash as the consequence of combustion of a fuel, such as pet coke or coal, that is fed into the boiler (B) from a fuel source (FS). The operation of the boiler (B) and the fuel source (FS) may be controlled using a control system (CS) that is operatively coupled to the boiler (B) and the fuel source (FS), as well as one or more sensors ($S_1$, $S_2$) operatively associated with the boiler (B) and the fuel source (FS) and one or more inputs (I) used to interact with the control system (CS). As a consequence, the control system (CS) may receive data from the user via the input (I) as to the desired output of the boiler (B) (or more particularly, as to the desired output of a steam generator (G) associated with the boiler (B)) and from the sensors ($S_1$, $S_2$) as to the temperature within the boiler (B) and the rate at which fuel (e.g., coal) and other materials required for combustion (e.g., oxygen/air) are fed into the boiler (B), for example.

Figure 3:
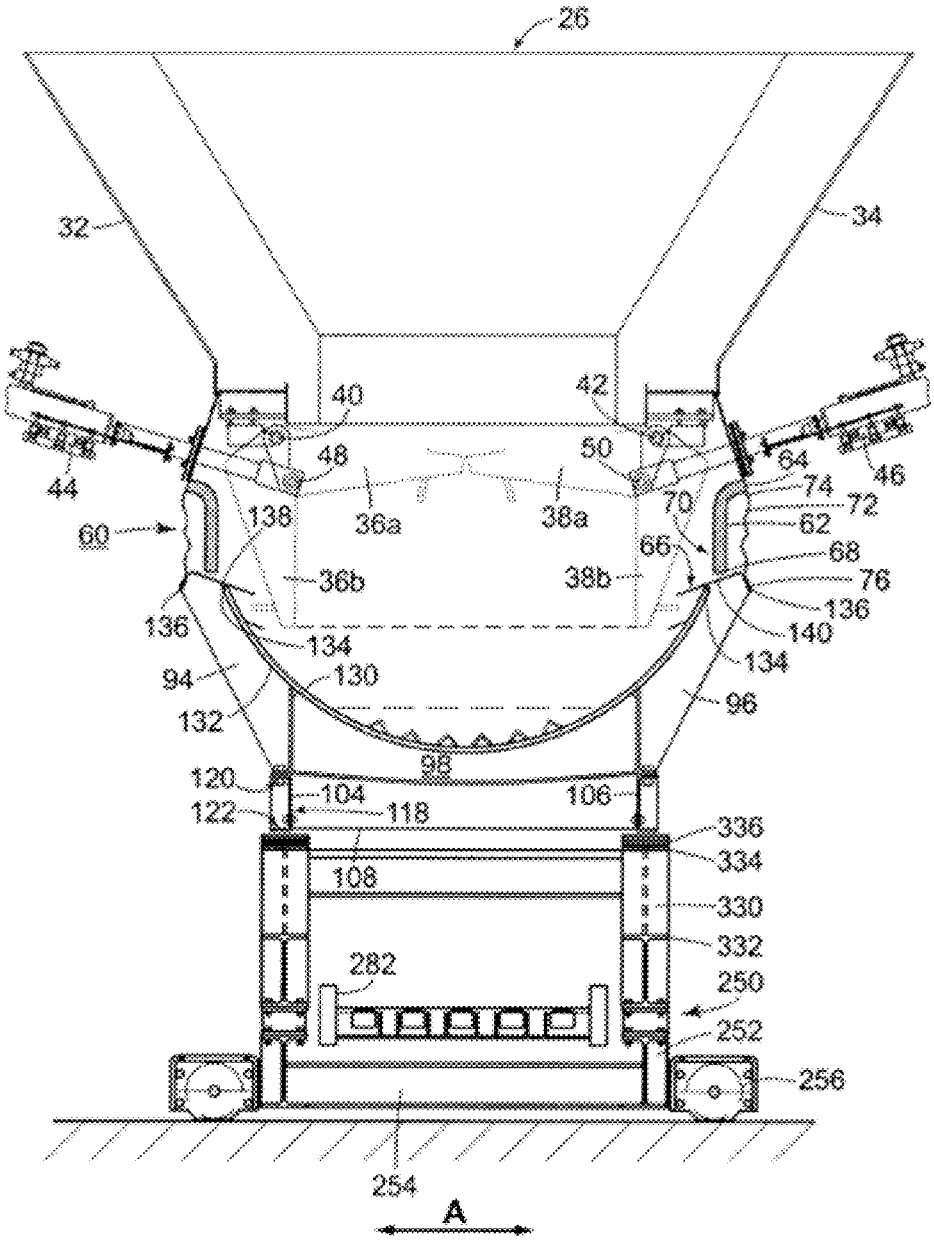
FIG. 3 is an enlarged, cross-sectional view of the conveyor illustrated in FIG. 1 taken along line 3-3.

The inner surface of the hopper 26 may be lined with refractory bricks to improve resistance to high temperatures. Further, the transition hopper 26 may have sloped ends 28, 30 (FIG. 2) and sloped sides 32, 34 (FIG. 3) which may assist in directing the heated ash into the conveyor 22. Moreover, as shown in FIG. 3, the hopper 26 may include doors 36, 38, which may be pivotally mounted to the hopper 26 at pivots 40, 42 so as to be moveable between a first, closed position or state 36*a*, 38*a* and a second, open position or state 36*b*, 38*b*. Additionally, actuators 44, 46 (e.g., hydraulic actuators) may be pivotally attached at pivots 48, 50 to the doors 36, 38, and may be operatively coupled to a controller (not shown) so as to selectively move the doors 36, 38 between the closed 36*a*, 38*a* and open 36*b*, 38*b* positions according to signals received from the controller.

As illustrated, the hopper 26 is supported independently from the conveyor 22. However, a seal assembly 60 (FIG. 3) bridges the space between the conveyor 22 and the hopper 26. The seal assembly 60 includes a guard 62 that is attached at an upper end 64 to the hopper 26, and that depends downward towards an upper edge 66 of the conveyor 22, leaving a space 68 between a lower edge 70 of the guard 62 and the upper edge 66 of the conveyor 22. The seal assembly 60 also includes a flexible, high-temperature seal 72 that is attached at its upper edge 74 to the hopper 26 and at its lower edge 76 to the upper edge 66 of the conveyor 22. The guard 62 limits material exiting the hopper 26 from impacting the seal 72. Overall, the expansion seal assembly 60 limits material from exiting the system 20, while isolating the conveyor 22 from movements of the hopper 26.

Turning to FIG. 2, the conveyor 22 includes a trough or trough assembly 80 which is supported on a wheeled frame 82. Material moves along the trough assembly 80 under the influence of vibrations induced in the trough assembly 80 by a vibratory generator 84, which as illustrated is a two-mass vibratory generator 84, although other vibratory generators may also be used with the conveyor 22 as described herein. Each component (trough assembly 80, frame 82, and vibratory generator 84) is now discussed separately.

Figure 4:
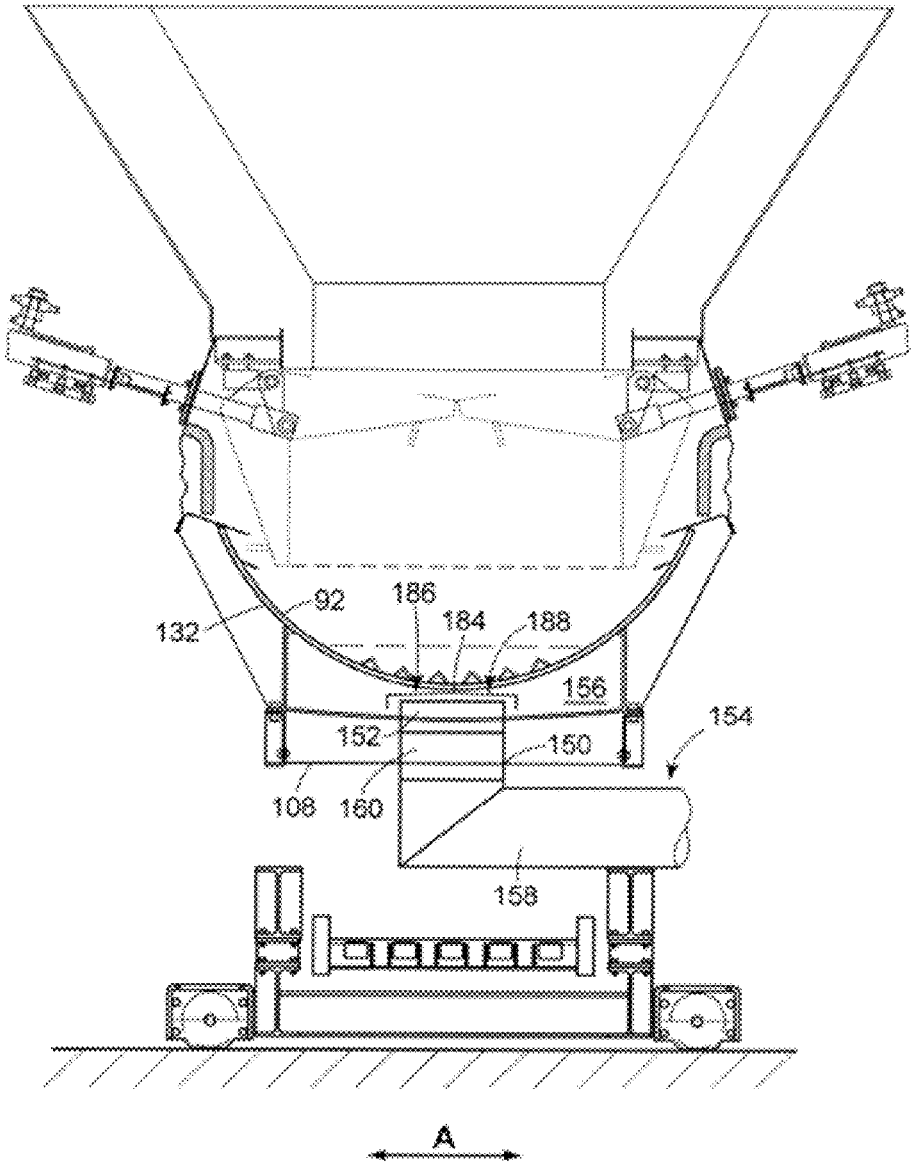
FIG. 4 is an enlarged, cross-sectional view of the conveyor illustrated in FIG. 1 taken along line 4-4.

Turning first to the trough assembly 80, with reference to FIGS. 1 and 2, it will be recognized that the assembly 80 includes a plurality of segments 90, each segment 90 being similar to the other segments 90 as illustrated, although this need not be the case in every embodiment of the conveyor 22. As illustrated in FIGS. 3 and 4, each segment 90 includes a trough segment 92 (which may be defined by a semi-circular, abrasion-resistant steel plate, for example, and collective referred to as a trough), outer support webs 94, 96, inner support web 98, structural members 104, 106, and bottom wall 108. One advantage of the use of the segmented or modular assembly may be the facilitation of relative thermal expansion along the trough. Another advantage of the use of a segmented or modular assembly, as opposed to a unitary assembly, may be improved ease of maintenance through the replacement of worn segments, for example, rather than replacement of a larger, unitary whole with worn sections. As illustrated in FIGS. 1 and 2, the receiving conveyor 22 includes ten segments 90, while the transfer conveyor includes four segments 90.

As shown in FIGS. 3 and 4, the trough segment 92 may then be disposed such that a lower surface 132 of the segment 92 abuts an upper edge 130 of the outer and inner support webs 94, 96, 98, and may be fastened to the webs 94, 96, 98 by welding, for example. The upper edges 134 of the trough segment 92 and upper edges 136 of the outer support webs 94, 96 may be spanned by rim plates 138, 140, which plates 138, 140 may be attached to the upper edges 136 of the outer support webs 94, 96 and the upper edges 134 of the trough segment 92, by welding, for example. It will be recognized that such an arrangement may accommodate the thermal expansion and contraction of the trough segment 92 relative to the remainder of the structure of the trough assembly segment 90 as the conveyor 22 receives heated material and cools and transports the heated material along its length.

As shown in FIG. 4, the bottom wall 108 may have an opening 150 formed therein, into which is disposed a first segment 152 of a conduit 154 through which air may pass as it is blown into a plenum 156 (which may run the entire length of the trough, for example) defined between the lower surface 132 of the trough segment 92 and the bottom wall 108. A second segment 158 of the conduit 154 may be disposed outside of the plenum 156 and may extend beyond the conveyor 22. As will be explained in greater detail with reference to FIG. 8, the segment 158 of the conduit 154 may be in communication with a blower which may cause air to be directed through the conduit 154 and into the plenum 156, and from the plenum 156 onto and into the heated material transported in the conveyor 22 to cool the material as it is transported along the conveyor 22. The first and second segments 152, 158 of the conduit 154 may be joined by a flexible connector 160, which may permit relative motion between the segments 152, 158, although the segments 152, 158 may themselves be flexible as well, which may make the connector 160 optional.

Figure 5:
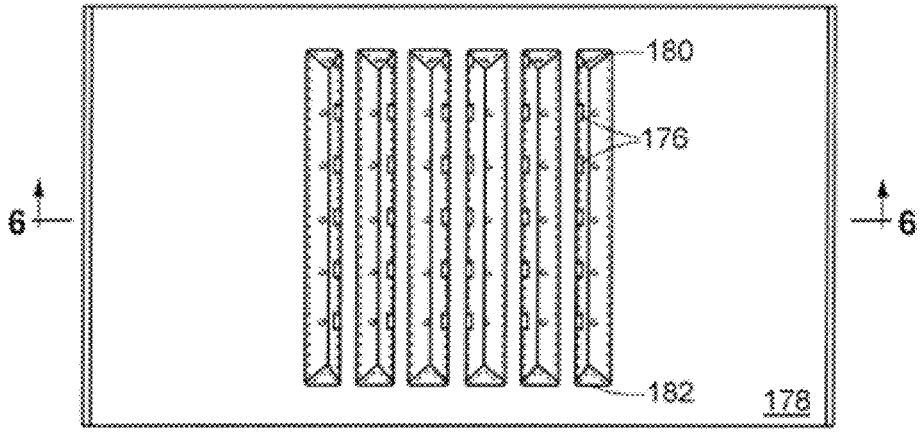
FIG. 5 is an enlarged, plan view of a trough segment of the conveyor of FIG. 1.
Figure 6:
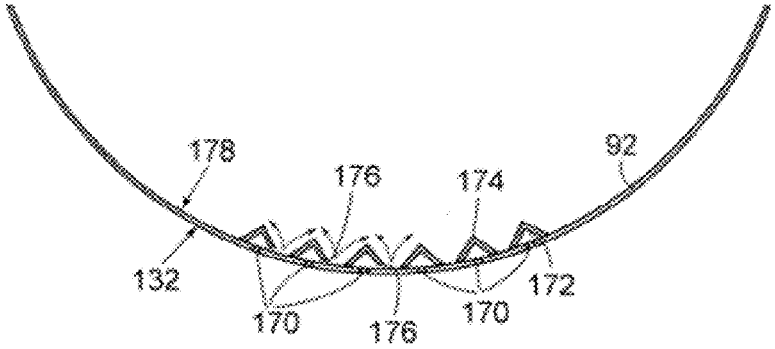
FIG. 6 is an enlarged, cross-sectional view of the trough segment illustrated in FIG. 5 taken along line 6-6.

As also shown in FIG. 4, but as more easily seen in FIG. 6, the wall of the trough segment 92 may have a plurality of apertures or passages 170 formed therethrough, to permit the air in the plenum 156 to exit the plenum 156. The apertures 170 may be arranged in sets, the sets of apertures being parallel to a longitudinal axis of the trough. The air passing through the apertures 170 is directed against a surface 172 of one of a plurality of baffles 174, which direct the air exiting the plenum 156 through the apertures 170 through a second plurality of apertures or passages 176 and thus along a section of an upper surface 178 of the segment 92. The direction of the air may thus change from the direction it takes as it passes through the apertures 170 to a direction roughly at right angles to the first direction as the air passes through the apertures 176. This arrangement of apertures 176 may also facilitate self-cleaning of particulate that may enter the baffles 174. As illustrated, the baffles 174 may be defined by a plate having two walls disposed in an L-shaped cross-section and triangular end caps 180, 182 (see FIG. 5), and attached to the trough segment wall, as illustrated.

It will be recognized, however, that while the baffles 174 are defined by an L-shaped plate as illustrated, other shapes are possible for the baffles 174. Moreover, while the apertures 176 are disposed on a single side of the baffles 174, the apertures 176 may be disposed on both sides of the baffles 174, if desired. Furthermore, while the apertures 176 direct the air flow along a section of the upper surface 178 of the trough segment 92, the air flow may be directed in another pattern entirely. The embodiment illustrated is thus one exemplary embodiment.

Returning then to FIG. 4, it will be recognized that the first segment 152 of the conduit 154 is open. It will further be recognized that to the extent that air may pass from the plenum 156 through the apertures 170, 176 into the space bounded by the trough segment 92, so too may particulate matter pass from the space bounded by the trough segment 92 through the apertures 170, 176 into the plenum 156. To limit the potential of such particulate matter (e.g., hot ash) from entering the open first segment 152, a tented cover 184 is placed between the open first segment 152 and the trough segment 90. The sloping surfaces 186, 188 of the cover 184 help to direct such particulate matter away from the open segment 152.

Figure 7:
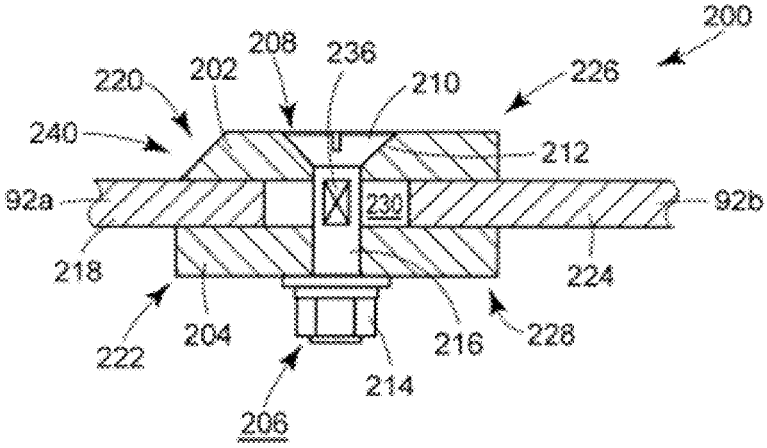
FIG. 7 is a fragmentary, enlarged, cross-sectional view of a joint between adjacent trough segments of the conveyor of FIG. 1.

To join the trough segments 92 together, a series of butt joints 200 may be formed, as illustrated in FIGS. 1 and 2 and in enlarged cross-section in FIG. 7. As illustrated in FIGS. 1 and 2, the receiving conveyor 22 includes ten butt joints 200, while the transfer conveyor 24 includes five butt joints 200.

Each butt joint 200 may include an inner band 202 and an outer band 204. The inner band 202 may be connected to the outer band 204 by a fastener set 206, as illustrated. In particular, the fastener set 206 includes a bolt 208, which has a head 210 that is received in a countersunk aperture 212 formed in the inner band 202, and a nut 214, which may be threadably connected to the shaft 216 of the bolt 208. An edge 218 of an upstream trough segment 92*a* may be disposed between the first ends 220, 222 of the inner and outer bands 202, 204, and an edge 224 of a downstream trough segment 92*b* may be disposed between the second ends 226, 228 of the inner and outer bands 202, 204. The fastener set 206 may then be tightened to grip the edges 218, 224 between the inner and outer bands 202, 204. The space 230 between the edges 218, 224 may allow relative motion between adjacent trough segments 92*a*, 92*b* caused by differences in thermal expansion.

Disposed within the space 230 may be spacer 236, such as may be formed of key stock. This spacer 236 may have a width that is slightly less than that of segments 92*a*, 92*b*. By placing the spacer 236 in the space 230, it is believed that the deflection and/or dishing of the inner and outer bands 202, 204 into the space 230 may be limited. By limiting the deflection and/or dishing of the inner and outer bands 202, 204, the relative thermal expansion of the segments 92*a*, 94*b* along the longitudinal axis of the trough may be facilitated.

Also of note relative to the butt joint 200, as illustrated, is the angled edge 240 of the inner band 202 at the first end 220. It is believed that the angled edge 240 of the inner band 202 may permit material flowing along the length of the conveyor to make a smoother transition from an upstream trough segment 92*a* to a downstream trough segment 92*b*. Alternatively, the butt joint 200 may be formed without the angled edge 240.

As mentioned previously, the trough assembly 80 is supported on a wheeled frame 82. As seen in FIGS. 2, 3, and 4, the wheeled frame 82 includes a base 250 which includes one or more longitudinal segments 252 that are connected by transverse segments 254. The longitudinal and transverse segments 252, 254 may be joined by welding, for example. Attached (e.g., bolted) to the base 250 at various lengths are wheel assemblies 256. The wheel assemblies 256 are pivotally mounted to the base 250 in such a way as to permit movement in the direction of the arrow "A" as shown in FIGS. 3 and 4. In operation, the wheel assemblies 256 may be disposed in such that they do not contact the floor, the wheel assemblies 256 being dropped down onto rails (not shown) embedded in the floor to enable movement of the conveyor from beneath the hopper 26. However, to limit the movement of the wheeled frame 82 and associated trough assembly 80, anchor bolts and nuts located along the base 250 may be used.

Figure 8:
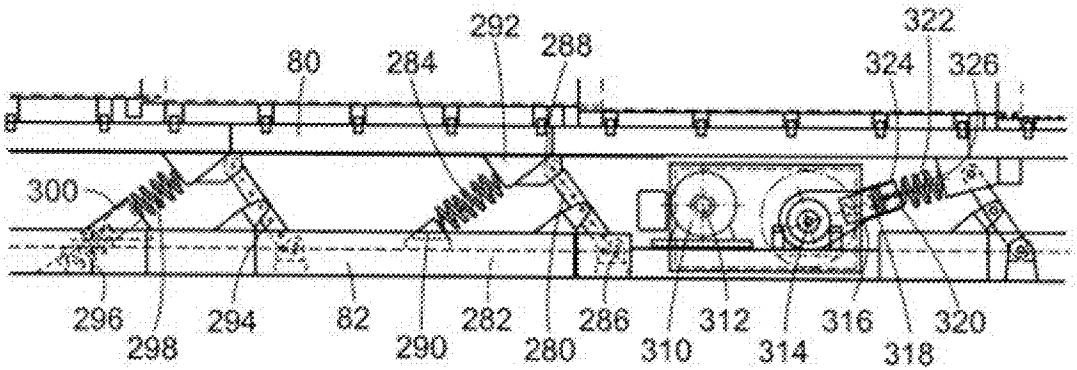
FIG. 8 is a fragmentary, enlarged, side view showing an associated vibratory generator and connections between the trough assembly, counterbalance and frame of the upper conveyor shown in FIG. 1.

As seen in FIG. 2 and to a greater degree in FIG. 8, the trough assembly 80 may be coupled to the frame 82 by a plurality of rigid links 280 and to a counterbalance 282 by a plurality of resilient members 284. The rigid links 280 may each be pivotally attached at a first end 286 to the frame 82 and at a second end 288 to the trough assembly 80, and the angle formed between each rigid link 280 and the bottom of the trough assembly 80 may be an obtuse angle. The resilient members 284, which may be springs and may be referred to as reaction springs, may each be fixedly attached at a first end 290 to the counterbalance 282 and at a second end 292 to the trough assembly 80, and the angle formed between each resilient member 284 and the bottom may be an acute angle. As illustrated, the plurality of links 280 and the plurality of resilient members 284 may be disposed in pairs, with the ends 288 of the links 280 and ends 292 of the resilient members 284 that make up each pair being attached to the trough assembly 80 adjacent to each other.

As also is visible in FIG. 8, the counterbalance 282 may be coupled to the frame 82 by a plurality of rigid links 294 and by a plurality of resilient members 296. Furthermore, the trough assembly 80 may be coupled to the frame 82 by a plurality of resilient members 298. In fact, the resilient members 296, 298, which may be springs, may be coupled to a tube 300 attached to the frame 82. The resilient members 296, 298 may be referred to as isolation springs, and may function to limit the transmission of vibrations to the floor.

Coupled between the trough assembly 80 and the counterbalance 282 is the vibratory generator 84, as seen in FIG. 2 and in greater detail in FIG. 8. The vibratory generator 84 may include a motor 310 with a shaft 312. The motor shaft 312 may be coupled to a driven shaft 314 by a drive belt (not shown). The driven shaft 314 may be an eccentric shaft. Attached to the eccentric shaft 314 via a flange cartridge bearing is a first end 316 of a link 318. A second end 320 of the link 318 is attached via a resilient member 322 to the trough assembly 80; that is, a first end 324 of the resilient member 322 is fixedly secured to the second end 320 of the link 318, while the second end 326 of the resilient member 322 is fixedly secured to the trough assembly 80. While one generator 84 has thus been discussed, other generators may be used according to the knowledge of one skilled in the art, and may be, for example, a brute force vibratory generator or a two-mass vibratory generator according to another arrangement.

Additionally, as illustrated in FIGS. 2 and 3, a series of columns 330 may be attached to the frame 82 along the length thereof. That is, each of the columns 330 has a lower end 332 that is fixedly attached, for example, by welding, to the frame 82, and an upper end 334 that depends in the direction of the trough assembly 80. Disposed on the upper end 334 of the column 330 is a shock absorber 336, which may be made of an elastomeric material. The ends of the structural members 104, 106 may cooperate with the shock absorbers 336 to limit the effect of material impacting the trough assembly 80, for example, from a great height.

Having thus described the conveyor 22, the conveyor 24 may be described as similar to the conveyor 22, except that the conveyor 24 is not mounted on wheels so as to be moveable. Instead, the frame of the conveyor 24 is attached to the floor. As seen in FIG. 1 and to a lesser degree in FIG. 2, material moves between a downstream end 340 of conveyor 22 to the conveyor 24 via a flexible chute 342, and similarly, material exits from the downstream end 344 of the conveyor 24 via a flexible chute 346.

Controlled Air Supply

Figure 9:
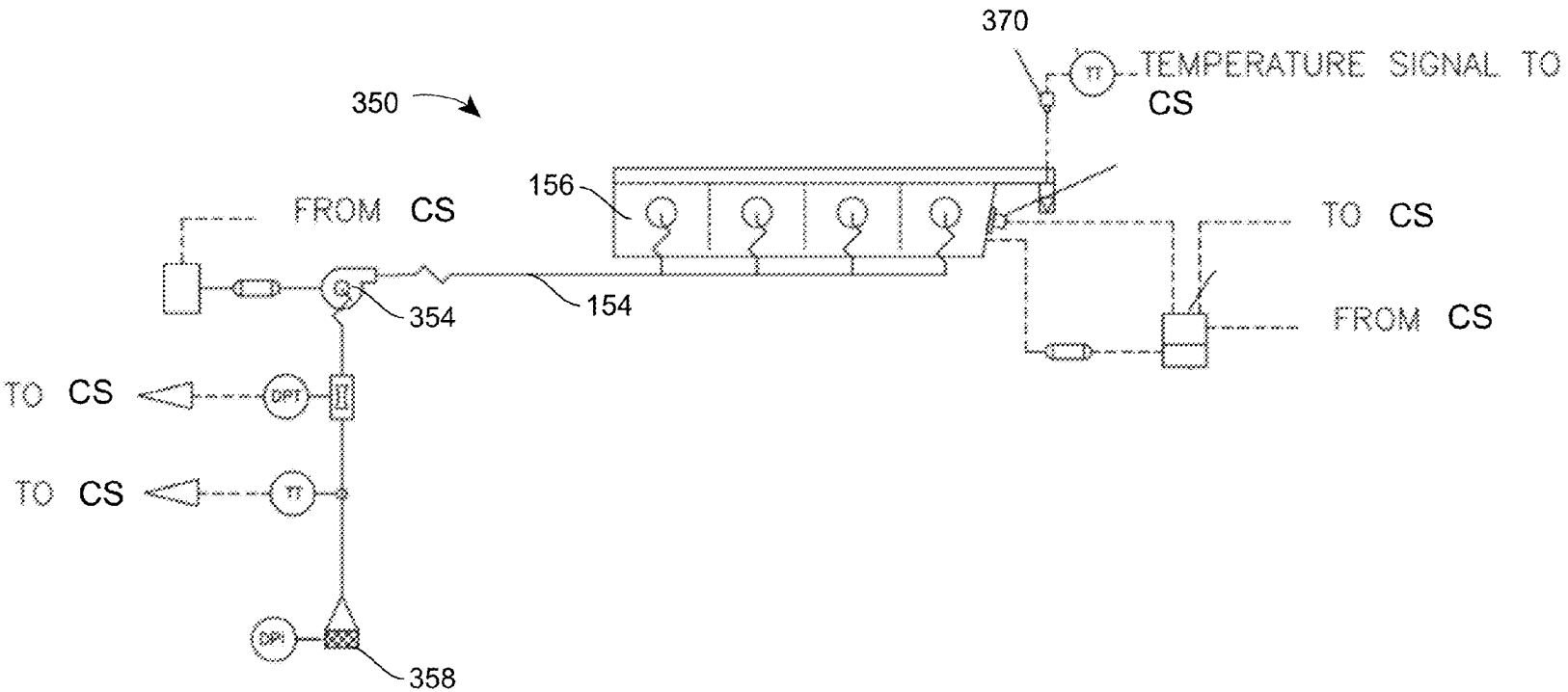
FIG. 9 is a schematic view of a controlled air supply system for use with the system illustrated in FIG. 2.
Figure 10:
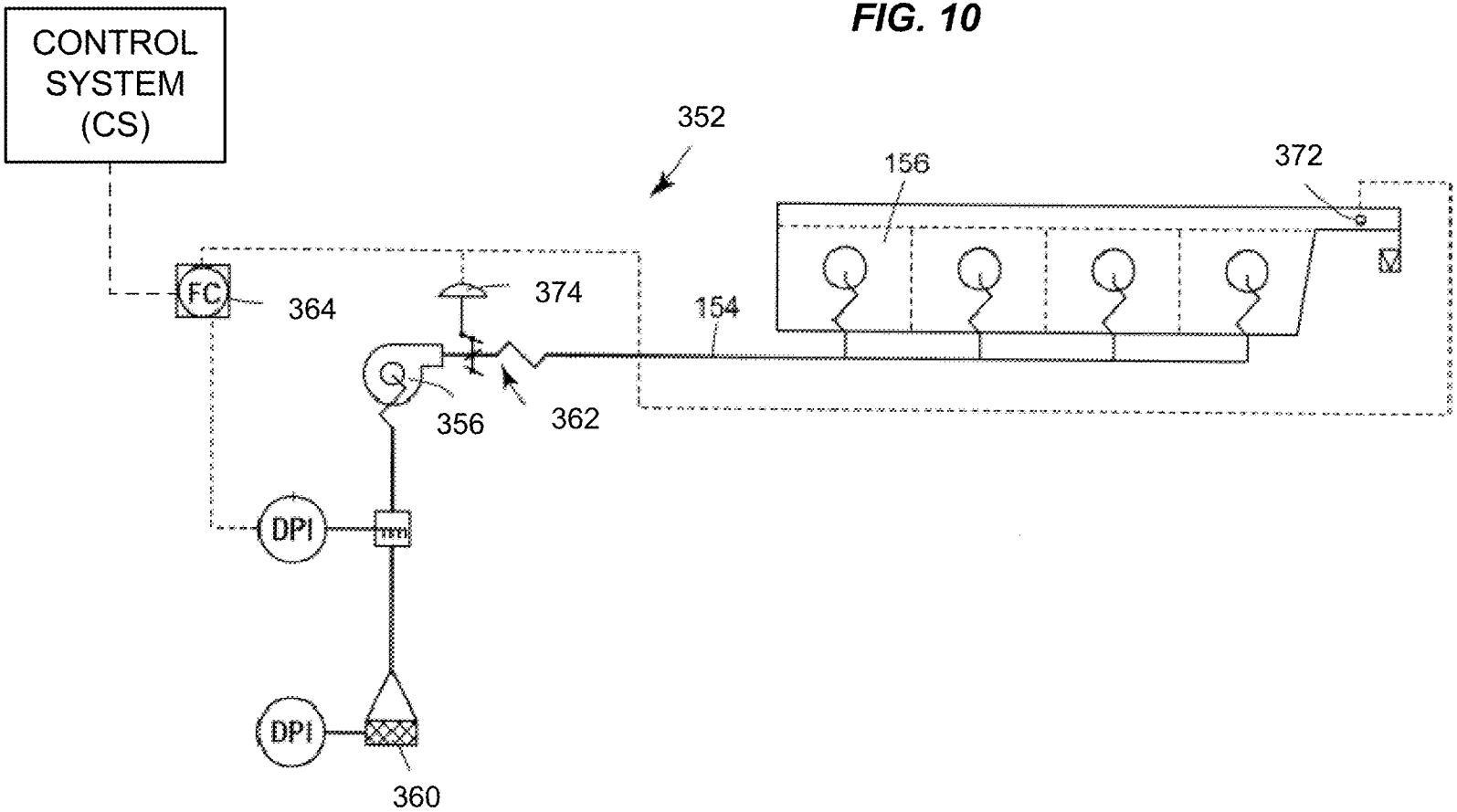
FIG. 10 is a schematic view of another controlled air supply system for use with the system illustrated in FIG. 2.

Associated with the conveyor system 20 is a controlled air supply, which may be referred to as part of the conveyor system 20 according to certain embodiments. Two variants of the controlled air supply 350, 352 are illustrated in FIGS. 9 and 10. The illustrated controlled air supplies 350, 352 are for use in combination with the conveyor system 20 illustrated above to control the carbon content of heated material passing through the conveyor system 20. It will be recognized that the supplies 350, 352 are not limited to use only in combination with the system 20, and the illustrated embodiments of the supplies 350, 352 are each merely an embodiment of a controlled air supply 350 that may be used to control the carbon content of a heated material passing through a conveyor system.

A single supply 350, 352 may be connected to both conveyors 22, 24, or a supply 350, 352 may be provided for each conveyor 22, 24 separately. As a further alternative, more than one supply may be provided for a single conveyor 22, 24.

The controlled air supply 350, 352 may include an adjustable air supply with a fan or blower 354, 356. According to certain embodiments, the air supply may also include an inlet filter 358, 360 and the afore-mentioned conduit 154 (which connects to the plenum 156 of various trough assembly segments 90). According to the embodiment illustrated in FIG. 10, the adjustable air supply also includes an adjustable damper 362 disposed between the blower 356 and the conduit 154. According to either embodiment, the fan 354, 356 may be equipped with a variable frequency drive (VFD) so as to permit the speed of the fan to be controlled. With such a VFD-equipped fan, the speed of the fan may be controlled to control the flow of the air in conjunction with or in substitution for control via the damper 362.

The supplies 350, 352 also may differ as to the controller used as part of the controlled air supply 350, 352. In particular, the controlled air supply 350 uses the control system (CS) as the controller to carry out the method of controlling carbon content in heated material (e.g., hot ash) disclosed herein. As such, the controller may be operatively coupled and programmed to operate the fan 354 according to the present disclosure, and may be programmed to control other equipment (such as to control the operational state of the boiler (B), for example). Alternatively, as illustrated relative to FIG. 10, the supply 352 may include a controller 364 separate and apart from the control system (CS), although according to certain embodiments of the present disclosure (including the illustrated embodiment), the controller 364 may be coupled to the control system (CS) to permit signals to be received from the control system (CS). It will be recognized that the reverse is also possible: the controller 364 used with the equipment of FIG. 9 and the controller (CS) used with the equipment of FIG. 10.

In either case, the controller (CS), 364 may be operatively coupled (e.g., over a wired connection or network, or via a wireless connection or network) to a temperature sensor 370, 372 associated with the trough of the conveyor 22, as well as other sensors or equipment. In accordance with the embodiment illustrated in FIG. 10, the controller 364 may also be operatively coupled to an actuator 374 operatively coupled to the damper 362. In response to signals returned to the controller (CS), 364 from the sensor 370, 372, the controller (CS), 364 may send a signal to the fan 354, 356 and/or actuator 374 to vary the air flowing through the conduit 154 into the plenum 156 in response to a signal from the sensor 370, 372.

According to an embodiment of a system and method to control the carbon content in the heated material (e.g., hot ash) in the conveyor system 20, one or more temperature sensors 370, 372 may be disposed at the downstream end 340 of the conveyor 22 (such as is illustrated schematically in FIGS. 9 and 10). It will be recognized that temperature sensors may be disposed elsewhere along the conveyor 22 in addition to or in substitution for the placement at the downstream end 340. It will also be recognized that other temperature sensors may be disposed along the conveyor 22, the operation of which is unrelated to the control of carbon content in the heated material, but instead is related to operation of the system to as to provide a more focused and localized response to variations along the conveyor 22, 24. In addition, other types of sensors may be included, either related or unrelated to the control of carbon content in the heated material.

According to the illustrated embodiment of a system and method to control the carbon content in the heated material, the controller (CS), 364 operates the fan 354, 356 and/or damper 362 in response to the signals received from the sensors 370, 372 to adjust the air supply to modulate the air flow to the conveyor 22 to maintain the temperature in the conveyor 22, and preferably within the heated material (e.g., the hot ash), constant. According to such an embodiment, the temperature in the conveyor 22 may experience fluctuations along the length of the conveyor 22, but the temperature profile in the conveyor 22 may be considered to be constant if the temperature at the discharge end 340 of the conveyor 22 remains within an acceptable operating range about a selected temperature. Furthermore, the temperature in the heated material may differ (either locally or throughout) from the temperature determined by the sensor 370, 372 in the conveyor 22 according to certain embodiments of the disclosure, but the temperature profile in the conveyor 22 may considered to be constant if the temperature determined by the sensor 370, 372 remains constant. It will be further recognized that the temperature as sensed by the sensor(s) 370, 372 may differ from that actual experienced within the conveyor 22, but the system and method according to the present disclosure may be described as operating to hold the temperature profile in the conveyor 22 constant if the temperature determined by the sensor 370, 372 remains within an operational range about a desired temperature. Of course, while the discussion is primarily centered about the conveyor 22, the same or similar approach may also be used with the conveyor 24.

According to certain embodiments of the present disclosure, the controller (CS), 364 operates the fan 354, 356 and/or damper 362 to maintain the temperature in the conveyor 22 constant at or above a temperature associated with controlled oxidation of unburned carbon in the hot ash within the trough in response to the signal from the temperature sensor 370, 372. That is, the hot ash entering the conveyor 22 from the hopper 26 may include a certain amount of carbon that remains uncombusted. This is undesirable because the remaining carbon represents "lost" thermal energy that might otherwise be used to heat the boiler (B). If the additional carbon can be combusted, thereby reducing the carbon content of the hot ash, boiler efficiency may be increased, coal consumption and carbon dioxide emissions may be decreased, and the ash may be in a better condition for reuse upon final discharge from the system 20. By maintain the temperature associated with controlled oxidation within the conveyor 22, and thus within the heated material traveling along the conveyor 22, it is believed that a considerable amount of the residual carbon in the heated material may be combusted within the conveyor 22.

For example, according to certain embodiments of the present disclosure, when the temperature sensor 370, 372 at the discharge end 340 of the conveyor 22 at the desired temperature (within an operational range), then the temperature of the heated material directly under the hopper 26 is at higher temperature to promote combustion. At this temperature, the carbon content within the heated material in the trough will continue to oxidize, and the carbon content of the heated material will be reduced. The difference between the temperature at the discharge end 340 of the conveyor 22 and the temperature within the heated material directly below the hopper 26 is a consequence of the additional air passed through the heated material, particularly in the region that is not directly under the hopper 26. The temperature at the discharge end associated with controlled oxidation of unburned carbon in the hot ash also may be less than a maximum discharge temperature for the hot ash, which must be maintained to prevent damage to equipment further downstream of the conveyor 22 or otherwise in accordance with operator requirements.

According to one such embodiment of the system and method to control the carbon content in the heated material, the controller (CS), 364 is programmed to consider not only the temperature in the conveyor 22 (as represented by the signal received from the sensor 370, 372), but also data concerning the operation of other equipment operatively coupled the control system (CS). According to the embodiment illustrated in FIG. 9, this additional data may be received by the portion of the controller (CS) that is operating as part of the controlled air supply 350, while in the embodiment illustrated in FIG. 10, the controller 364 may be operatively coupled to the control system (CS) and receive from the control system (CS) the additional data.

For example, the controller (CS), 364 may receive data on volume of hot ash being delivered into the conveyor 22 from the hopper 26, which may be in the form of an ash fall rate. The ash fall rate may vary according to the operation of the boiler (B). In fact, the controller (CS), 364 may receive a mode signal regarding an operational state or mode of the boiler (B). For example, the controller (CS), 364 may receive a normal operational mode signal when the boiler (B) is operating to provide an ash fall rate that occurs more frequently during the operation of the boiler (B), which ash fall rate may be within a range of ash fall rates (i.e., a normal operational state of the boiler (B)). The ash fall rate may be approximately X tons/hour for normal operation of the boiler (B) according to certain embodiments of the system as described herein. Alternatively, the controller (CS), 364 may receive an abnormal operational mode signal when the boiler (B) is operating to provide an ash fall rate that occurs less frequently during the operation of the boiler (B) (i.e., an abnormal operational state of the boiler (B)). The ash fall rate may be at least an order greater than that of the normal operation of the boiler (B) according to certain embodiments of the system described herein. For example, the ash fall rate during abnormal (or "upset") operation of the boiler (B) may be approximately 10× tons/hour.

According to these operational mode signals, in combination with the temperature as determined by the sensor 370, 372, the controller (CS), 364 may determine what changes, if any, are necessary in regard to the operation of the fan 354, 356 and/or damper 362. As will be recognized, the controller (CS), 364, sensors 370, 372 and fan 354, 356/dampers 362 define a closed loop control system relative to the temperature in the conveyor 22. Consequently, the controller (CS), 364 may be programmed according to any known closed loop control algorithm to utilize the data available, such as the temperature data (as represented by the signal from the sensor 370, 372) along with operational mode signal (when available) to determine the changes required in the flow rate of cooling air to the conveyor 22 so as to maintain the temperature in the conveyor 22 as a constant, i.e., within an operational range about a desired value.

For example, according to an embodiment of the present disclosure that considers not only the temperature at the discharge end 340, but also the operational mode of the boiler (B), the controller (CS), 364 may be programmed to adjust the air supply to maintain a constant temperature associated with the controlled oxidation of unburned carbon in the hot ash in response to the signal received from the temperature sensor 370, 372 and a mode signal associated with a normal operational state of the boiler (B). On the other hand, the controller (CS), 364 may be programmed to interrupt adjustment of the air supply to maintain a constant temperature associated with controlled oxidation of unburned carbon in the hot ash within the trough in response to a mode signal associated with an abnormal operational state of the boiler. When the abnormal operational state of the boiler is present, which may correspond to an increase (e.g., an order of magnitude) in delivery of hot ash to the conveyor relative to the delivery of hot ash during the normal operation state of the boiler (B), it may not be practical to control the operation of the adjustable air supply according to the first temperature. Instead, the controller (CS), 364 adjusts the air supply to maintain a constant temperature associated with a maximum discharge temperature in response to the mode signal associated with the abnormal operational state of the boiler.

Figure 11:
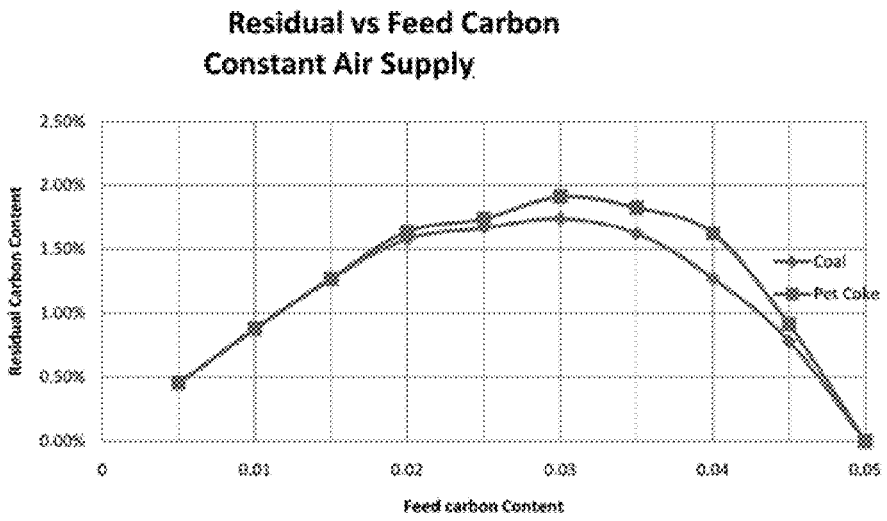
FIG. 11 is a graph illustrating the reduction in carbon content when controlling the air supply to maintain a constant air flow rate.
Figure 12:
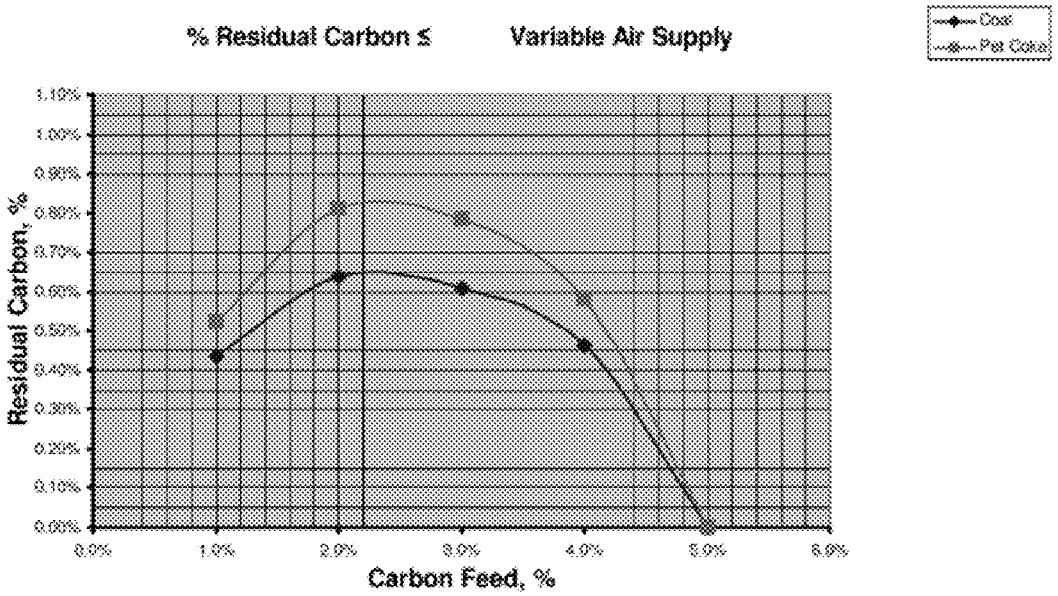
FIG. 12 is a graph illustrating the reduction in carbon content when controlling the air supply to maintain a constant temperature associated with controlled oxidation of unburned carbon in the hot ash within the trough.

FIGS. 11 and 12 are graphs illustrating the reduction in the carbon content of heated material (e.g., hot ash) passing through a conveyor system similar to that illustrated in FIG. 2. In particular, the graph in FIG. 11 illustrates the carbon content in hot ash (as measured at the discharge end) passing through a system such as the one described above, used in conjunction with a controlled air supply similar to the one described above, where the controlled air supply provides a constant (with an acceptable degree of certainty) air flow rate to the conveyor. The graph in FIG. 12 illustrates the carbon content in hot ash (as measured at the discharge end) passing through a system such as the one described above, used in conjunction with the controlled air supply described above, where the controlled air supply maintains a constant temperature in the conveyor associated with controlled oxidation of unburned carbon in the hot ash within the trough. As can be seen by comparing FIG. 12 with FIG. 11, the carbon content in the hot ash is significantly reduced (e.g., in excess of 40%) for the disclosed system and method for controlling the carbon content in the hot ash over a wide range of levels of entering carbon content when viewed relative to a system wherein the air flow is controlled for a constant rate of air flow delivery.

Thus, according to one method of operation, heated material may be received in the hopper 26. When the doors 36, 38 are selectively moved from their closed position 36*a*, 38*a* to their open position 36*b*, 38*b* (or some position therebetween), the heated material (hot ash) may be received in the conveyor 22, and in particular the trough. The material may be directed along the conveyor 22 in accordance with the vibrations provided by the vibratory generator 84.

The frequency of the motor associated with the vibratory generator 84 may be used to control, for example, the speed of translation of the material along the conveyor 22. In fact, the operation of the motor may be varied between a high speed and a low speed to provide an average velocity of the material in the conveyor 22. For example, the motor may operate according to a duty cycle where periods of high speed operation are alternated with periods of low speed operation, and according to certain embodiments the periods of high speed operation are considerably shorter in duration than the periods of low speed operation. This control of the motor speed may assist in providing a relatively consistent depth for the bed of heated material moving along the conveyor 22.

As the material moves along the conveyor 22, and in particular along the trough segments 92, air may be blown onto and (according to the consistency of the heated material) through the heated material. In particular, in accordance with the signals provided by the temperature sensor 370, 372, the controller (CS), 364 may vary the operation of the fan 354, 356 or the position of the damper 362 (through control of the associated actuator 374) to provide a certain flow of air into the plenum 156 associated with the various segments 90 of the conveyor 22 to maintain a constant temperature in the conveyor 22, which may involve increasing the amount of air entering the conveyor 22 or reducing the amount. Air passing through the conduit 154 and entering the plenum 156 passes through the apertures 170, 176 so as to be directed onto the heated material moving along the conveyor 22. When the material reaches the downstream end 340 of the conveyor 22, the material passes through the chute 342.

The above-described conveyor system 32 and method conveying heated material may be particularly advantageous for use in hot ash recovery, and in particular dry hot ash recovery.

Ash (also referred to as bottom ash) produced by coal-fired boilers can be beneficially used in a variety of construction and manufacturing applications, including as structural and engineering fill, cement raw material, aggregate for concrete and asphalt products and general reclamation purposes. A utility-sized, coal-fired boiler can produce large volumes of this ash. However, standard methods of ash recovery involve the use of water as a cooling fluid for the hot ash. The use of water for cooling purposes results creates operational and maintenance difficulties and inefficiencies, including the issues associated with drying the wet ash out once it is cooled so that it may be used in the afore-mentioned construction and manufacturing applications.

Use of the conveyor and conveying system according to the present disclosure may provide a way to avoid the difficulties and inefficiencies of the prior wet ash recovery methods. A coal-fired boiler plant may be equipped with one or more transition hoppers 26. These hoppers 26 may be sealed to the bottom of the boilers using a dry-type or water-impounded seal. The hoppers 26 may be independently supported from the boiler.

One or more conveyors 22 may be disposed beneath the hoppers 26 to receive the hot ash contained therein. The hot ash material moves forward by "throws and catches" from one point to the next because of the action of the vibratory generator 84, which motion also may minimize the sliding abrasion on the conveyor 22. It is believed that as air enters the trough through the apertures 170, 176, it passes over the trough surface and through the hot ash as the ash continues its motion along the hopper 26. It is further believed that this intimate, direct contact between the air and the ash as the air moves through the ash bed minimizes the amount of cooling air required for a specific ash temperature drop. It is also believed that the velocity of the air flow over the trough surface may be controlled so that it is not so fast as to fluidize the ash bed, thus permitting conveyance of the ash up an incline. It is also thought that one advantage of using air, rather than water, as the cooling fluid is that combustion of unburnt carbon pieces in the hot ash may continue, thus potentially improving overall heat recovery and boiler efficiency. A further advantage, according to an embodiment configured as a system to control carbon content in the heated material, is that the carbon content of the heated material may be reduced, relative to an embodiment wherein the air flow is controlled for constant mass or volume flow rate, such that the efficiency of the boiler (B) may be improved, consumption of fuel and emissions may be reduced, and the characteristics of the ash may be more suitable for reuse or a wider range of reuses.

What is claimed is:

1. A system for reducing carbon content of hot ash, the system comprising:

a conveyor including a trough to receive a quantity of hot ash, the trough having a trough wall with a plurality of apertures through which air may pass, and a vibratory generator operatively coupled to the trough to move the quantity of hot ash along the trough; and a controlled air supply including an adjustable air supply, a temperature sensor operatively associated with the trough, and a controller operatively coupled to the adjustable air supply and the temperature sensor, the controller programmed to adjust the air supply to maintain a constant temperature associated with controlled oxidation of unburned carbon in the hot ash within the trough in response to the signal received from the temperature sensor.

2. The system according to claim 1, wherein the temperature associated with controlled oxidation of unburned carbon in the hot ash is less than a maximum discharge temperature for the hot ash.

3. The system according to claim 1, wherein the conveyor receives hot ash from a hopper operatively associated with a boiler, the controller receiving a mode signal regarding an operational state of the boiler, the controller programmed to adjust the air supply to maintain a constant temperature associated with controlled oxidation of unburned carbon in the hot ash within the trough in response to the signal received from the temperature sensor and a mode signal associated with a normal operational state of the boiler.

4. The system according to claim 3, wherein the controller is programmed to interrupt adjustment of the air supply to maintain a constant temperature associated with controlled oxidation of unburned carbon in the hot ash within the trough in response to a mode signal associated with an abnormal operational state of the boiler.

5. The system according to claim 4, wherein the controller is programmed to interrupt adjustment of the air supply to maintain a constant temperature associated with controlled oxidation of unburned carbon in the hot ash within the trough and to adjust the air supply to maintain a constant temperature associated with a maximum discharge temperature in response to the mode signal associated with the abnormal operational state of the boiler.

6. The system according to claim 4, wherein the constant temperature associated with controlled oxidation of unburned carbon in the hot ash is less than the maximum discharge temperature.

7. The system according to claim 4, wherein the abnormal operational state corresponds to an increase in delivery of hot ash to the conveyor relative to the delivery of hot ash during the normal operational state.

8. The system according to claim 7, wherein the increase in delivery of hot ash to the conveyor is an order of magnitude greater during the abnormal operational state.

9. The system according to claim 3, wherein the controller is part of a control system coupled to the boiler to control the operational state of the boiler.

10. The system according to claim 1, wherein the air supply comprises a blower in communication with the plurality of apertures.

11. The system according to claim 10, wherein the blower is a fan with a variable frequency fan.

12. The system according to claim 10, wherein the air supply comprises an adjustable damper disposed between the blower and the plurality of apertures, the damper operatively coupled to the controller.

* * * * *